United States Patent [19]

Kuhlman

[11] Patent Number: 4,968,073

[45] Date of Patent: Nov. 6, 1990

[54] RELEASE FOR CLOSURE PANEL PULL DOWN MECHANISM

[75] Inventor: Howard W. Kuhlman, Troy, Mich.

[73] Assignee: General Motors Corporation, Detroit, Mich.

[21] Appl. No.: 372,440

[22] Filed: Jun. 27, 1989

[51] Int. Cl.[5] ..... E05C 3/26

[52] U.S. Cl. ..... 292/201; 292/216

[58] Field of Search ..... 292/201, 216, 341.16, 292/DIG. 14, DIG. 43, 280

[56] References Cited

U.S. PATENT DOCUMENTS

| | | | |
|---|---|---|---|
| 3,743,335 | 7/1973 | Reilhac et al. | 292/DIG. 14 X |
| 4,746,153 | 5/1988 | Compeau et al. | 292/216 |
| 4,796,932 | 1/1989 | Tame | 292/DIG. 43 X |

*Primary Examiner*—Richard E. Moore

*Attorney, Agent, or Firm*—Charles E. Leahy

[57] ABSTRACT

A vehicle body compartment is closed by a closure panel movable between an open positiion and a closed position. A latch assembly mounted on the panel has a latch bolt spring biased to an unlatched position and normally maintained in the latched position by a detent lever. A pull down mechanism includes a housing mounted on a vehicle body and a striker mounted thereon by a motorized vertically reciprocating drive unit for moving the striker between extended position and a retracted position. When the panel is moved toward the closed position, the latch bolt engages with the extended striker to interconnect the panel with the striker. The drive unit is energized and retracts the striker, thereby pulling the panel to its fully closed position. To open the panel, the operator energizes the drive unit to move the striker from the retracted position to the extended position. A plunger is mounted on the latch assembly and engages with the vehicle body so that progressive opening movement of the panel by the extension of the striker permits a spring to extend the plunger. A cam device acts between the plunger and the detent lever of the latch assembly to cam the detent lever to the position releasing the latch bolt, thereby disconnecting the panel from the striker and freeing the panel for movement to the open position.

5 Claims, 2 Drawing Sheets

RELEASE FOR CLOSURE PANEL PULL DOWN MECHANISM

The invention relates to a latch mechanism for a pull down mechanism for closing a vehicle closure panel and more particularly provides an improved plunger operated release for the latch.

BACKGROUND OF THE INVENTION

It is well known in the prior art to provide a vehicle body closure panel, such as a rear deck lid, which is hingedly mounted and spring loaded for movement to an open position. A latch assembly is mounted on the panel and has a latch bolt which is spring biased to an unlatched position. When the deck lid is slammed to a closed position, the latch bolt latches with a striker mounted on the vehicle body to latch the panel in the closed position. The latch assembly traditionally includes a detent lever which holds the latch bolt in the latched position and a key cylinder for releasing the detent lever from the latch bolt so that the latch bolt is spring biased to the unlatched position releasing the panel for movement to its open position.

It is also well known in the prior art to provide a motorized pull down mechanism for pulling the panel to the fully closed position, thereby eliminating the need for the user to slam the panel. The pull down mechanism traditionally includes a housing mounted on the vehicle body and having the striker mounted thereon by a motorized vertically movable drive unit for movement between an extended position and a retracted position. When the striker is extended, closing movement of the panel causes the latch bolt to engage the striker so that the panel and striker are latched together. This engagement closes a switch and energizes the motorized drive unit to retract the striker and thereby pull the panel to the fully closed position. When the panel is returned to the open position by operating the key or by remote electrical operation from inside the passenger compartment, the motorized drive unit moves the striker from the retracted position to the extended position in readiness for subsequent engagement by the latch bolt upon closing movement of the panel.

U.S. Pat. No. 4,746,153 by David E. Compaeu et al, assigned to the assignee of this invention, provided an improvement in the aforedescribed pull down unit in which a cam mechanism was provided in association with the latch assembly to cam the detent lever to the position releasing the latch bolt in response to initial upward opening movement of the latch assembly by the motorized striker so that the latch bolt would be spring biased to unlatch from the striker and thereby free the closure panel for spring loaded movement to the opened position.

The present invention provides a further improvement in the release mechanism of U.S. Pat. No. 4,746,153 and includes a spring loaded plunger which projects from the latch assembly and operates a cam mechanism to release the detent lever from the latch bolt.

SUMMARY OF THE INVENTION

A vehicle body compartment is closed by a closure panel movable between an open position and a closed position A latch assembly mounted on the panel has a latch bolt spring biased to an unlatched position and normally maintained in the latched position by a detent lever A pull down mechanism includes a housing mounted on a vehicle body and a striker mounted thereon by a motorized vertically reciprocating drive unit for moving the striker between extended position and a retracted position When the panel is moved toward the closed position, the latch bolt engages with the extended striker to interconnect the panel with the striker. The drive unit is energized and retracts the striker, thereby pulling the panel to its fully closed position. To open the panel, the operator energizes the drive unit to move the striker from the retracted position to the extended position. A plunger is mounted on the latch assembly and engages with the vehicle body so that progressive opening movement of the panel by the extension of the striker permits a spring to extend the plunger A cam device acts between the plunger and the detent lever of the latch assembly to cam the detent lever to the position releasing the latch bolt, thereby disconnecting the panel from the striker and freeing the panel for movement to the open position.

BRIEF DESCRIPTION OF THE DRAWINGS

These and other objects, features and advantages of the invention will become apparent upon consideration of the specification and the appended drawings in which.

DESCRIPTION OF THE PREFERRED EMBODIMENT

Figure 1:
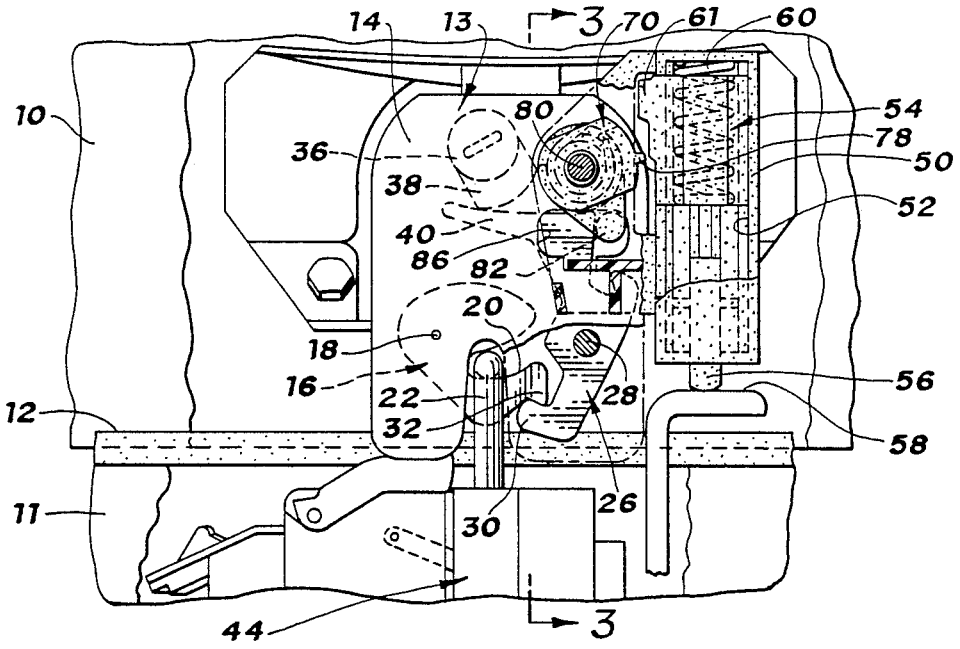
FIG. 1 is an elevation view of the compartment panel latch and the pull down mechanism, shown in the position in which the latch assembly has been engaged with the striker of the pull down unit and the striker retracted downwardly to completely close the closure panel 10.

Referring to FIG. 1, a deck lid closure panel of a vehicle body is indicated at 10. The panel is hingedly mounted on the vehicle body for movement between open and closed positions with respect to a vehicle compartment. The panel is spring loaded for movement to the open position. FIG. 1 also shows a vehicle body panel 11 which defines the compartment opening 12 which is selectively closed by the closure panel 10.

The closure panel 10 may be latched in a closed position by a latch assembly generally indicated at 13 which is mounted on the closure panel 10. The latch assembly 13 includes a housing 14 having a latch bolt 16 mounted thereon by pivot 18. The latch bolt 16 has an opening 20 by which the latch bolt 16 is engageable with a striker 22 carried by the body panel 11 to latch and interconnect the closure panel 10 with the body panel 11. The latch assembly 13 includes a spring, not shown, which biases the latch bolt 16 to the unlatched position shown in phantom line in FIG. 2. The latch assembly 13 also includes a detent lever 26 mounted on housing 14 by pivot 28 and having a hook 30 which engages with a hook 32 of the latch bolt 16 to hold the latch bolt 16 in a latched position with respect to the striker 22 as shown in FIG. 1. A spring urges detent lever 26 to the position of FIG. 1.

Figure 2:
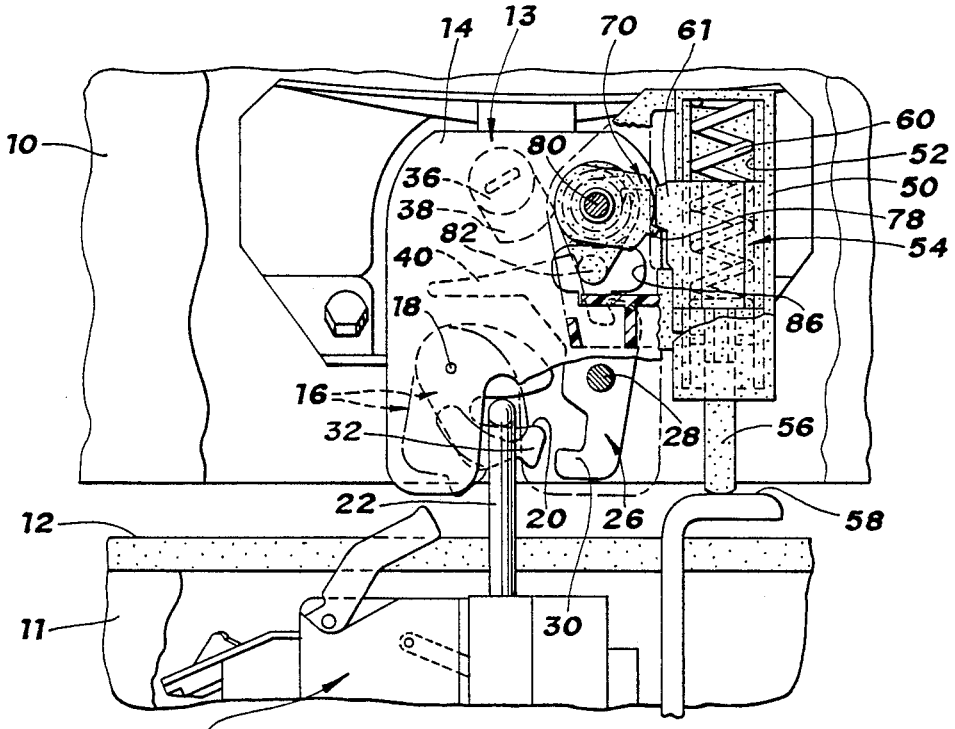
FIG. 2 is a view similar to FIG. 1 but showing the motor of the pull down unit having been reversed to extend the striker upwardly so that the closure panel is being raised and a plunger associated with the latch is being extended to unlatch the latch assembly from the striker so that the closure panel 10 is freed for movement to the full open position.

The latch assembly 13 also includes a key operated lock cylinder 36 which is rotatable when a properly bitted key is inserted The key cylinder 36 carries a cam 38 which, upon rotation of the key cylinder 36, engages a cam follower portion 40 of the detent lever 26 to pivot the detent lever 26 about its pivot 28 to the position shown in FIG. 2 and thereby disengage the detent lever hook 30 from the latch bolt hook 32 so that the spring, not shown, returns the latch bolt 16 to its unlatched position of FIG. 2, to disconnect the latch assembly 13 from the striker 22 and enable the closure panel 10 to be moved to its open position by the closure panel spring.

Referring again to FIG. 1, a pull down mechanism, generally indicated at 44, is provided for moving the closure panel 10 from its partially closed position of FIG. 2 to the fully closed position of FIG. 1. The striker 22 is mounted on a jackscrew not shown. A reversible electric motor is connected with the jackscrew by a suitable mechanism including a drive nut which meshes with the jackscrew to raise and lower the jackscrew and the striker 22 attached thereto upon energization of the motor. The jackscrew and striker 22 are movable in a vertically reciprocable fashion between the retracted position of FIG. 1 and the partly extended position of FIG. 2. In the retracted position of FIG. 1, the panel 10 is pulled down to its fully closed position in which the closure panel 10 seats upon a weatherstrip carried by the body panel 11.

Reference may be had to U.S. Pat. No. 4,746,153 for a more complete description of the pull down unit 44 and the electrical circuit for operating the pull down unit.

The invention relates to a release mechanism provided to unlatch the latch assembly 13 from the striker 22 independently of the operation of the lock cylinder 36 discussed hereinbefore.

Figure 3:
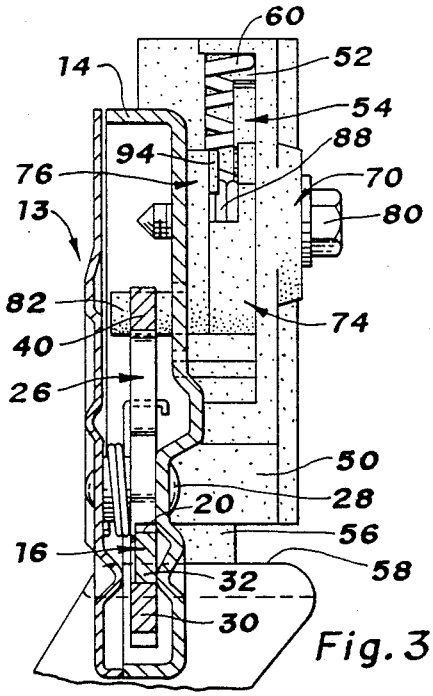
FIG. 3 is a sectional view taken in the direction of arrows 3—3 of FIG. 1.

The release mechanism, as best shown in FIGS. 1 and 3 is housed within a molded plastic housing 50 which is attached to the housing 14 of latch assembly 13. As best seen in FIG. 1, the plastic housing 50 includes a vertically extending chamber 52 in which a plunger 54 is reciprocably mounted for movement between a fully retracted position shown in FIG. 1 and a partly extended position shown in FIG. 2. As seen in FIGS. 1 and 2, an end 56 of the plunger 54 extends from the housing 50 and into engagement with a stop surface 58 which is carried by the body panel 11 or may be attached to the housing of the pull down unit 44. A coil compression spring 60 is mounted within the housing 50 and acts between the housing 50 and the plunger 54 to urge the plunger 54 to the extended position of FIG. 2. The plunger 54 carries a cam portion 61 which includes a riser 62, a dwell portion 64 and a riser 66.

The release mechanism also includes a actuating cam assembly generally indicated at 70, which is interposed between the plunger 54 and the cam follower portion 40 of the detent lever 26. As best seen in FIG. 3, the actuating cam assembly 70 includes a cam disc 74 and an actuating operating lever 76 which are rotatably mounted on a mounting bolt 80 which extends through the housing 50 and into the latch housing 14. The cam disc 74 has a integral projection 78 which is positioned in the path of movement of the cam portion 61 of the plunger 54. The actuating lever 76 has a lateral arm 82 which projects through a window 86 of the latch housing 14 and into engagement with the cam follower portion 40 of the detent lever 26.

Figure 4:
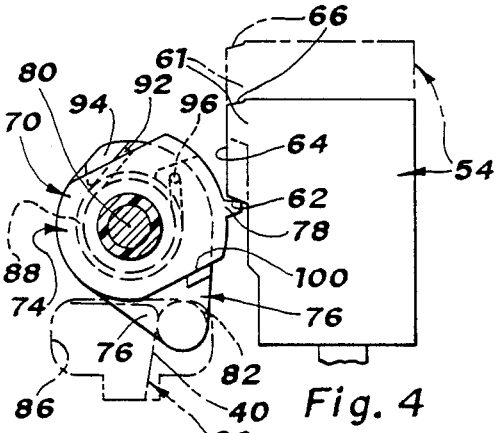

As best seen in FIGS. 3 and 4 a torsion spring 88 encircles bolt 80 and has a first end 92 engaging abutment 94 of the operating lever 76 and a second end 96 which is suitably anchored on the cam disc 74. The spring ends 92 and 96 urge the cam disc 74 in the clockwise direction with respect to the operating lever 76 as viewed in FIG. 4 so that the cam disc 74 will normally rest upon a stop abutment 100 which is formed in integrally with the operating lever 76.

Latch Operation

Referring to FIG. 1, it is seen that the vehicle user has moved the closure panel 10 downwardly to carry the latch bolt 16 of latch assembly 13 into latching engagement with the striker 22. Latch bolt 16 has been rotated to its latching position in which the striker 22 is captured in the slot 20 of of latch bolt 16. Hook 30 of detent lever 26 engages with hook 32 of the latch bolt 16 to retain the latch bolt 16 at the latched position Downward retracting movement of the striker 22 has pulled the panel 10 downwardly to the fully closed position of FIG. 1.

With the compartment panel 10 fully closed as shown in FIG. 1, the plunger 54 is fully retracted within the housing 50 by virtue of the plunger end 56 engaging with the abutment surface 58 carried by the vehicle body panel 11. This fully retracted position of the plunger 54 as shown in FIG. 1, and also shown in phantom line in FIG. 4, poises the cam portion 61 of the plunger at a distance from the projection 78 of the cam disc 74. Accordingly, the cam disc 74 and the actuating lever 76 are poised at the relative rotary positions of FIG. 4 and the lateral arm 82 of the actuating lever 76 is poised in engagement with the cam follower portion 40 of the detent 26 as shown in FIG. 1.

Figure 6:
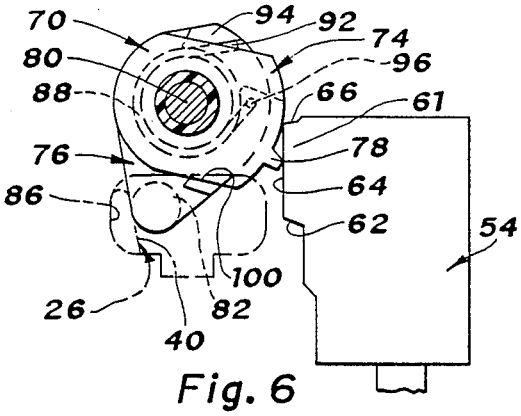
FIGS. 4–8 show the various operating positions of a intermediate lever and cam follower which act between the spring loaded plunger and the detent lever of the latch assembly.
Figure 5:
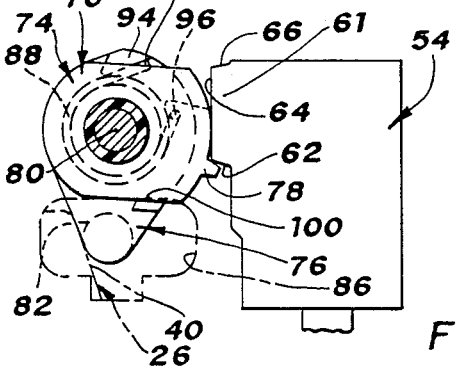

Referring to FIG. 2 it will be understood that unlatching of the latch assembly 13 from the striker 22 in order to enable opening movement of the closure panel 10, is initiated by actuating the pull down unit to extend the striker upwardly from the FIG. 1 position towards the FIG. 2 position. The upward extending movement of the striker 22 raises the latch assembly 13 and the closure panel 10 so that the plunger 54 is permitted to be extended from its housing 50 by the action of the coil compression spring 60. As the plunger 54 is extended from the housing from the phantom indicated position of FIG. 4 to the solid line indicated position of FIG. 4, the riser 62 of the plunger cam portion 61 engages with the projection 78 of cam disc 74. Further extending movement of the plunger 54 to the position shown in FIG. 5 forcibly rotates the cam disc 74 in the clockwise direction and the cam disc 74 in turn drives the actuating lever 76 in the clockwise direction by virtue of the engagement of the cam disc 74 with the stop 100 of the actuating lever 76. As the actuating lever 76 is rotated in the clockwise direction the lateral arm 82 thereof forcibly rotates the detent lever 26 against the bias of its spring to the rotary position shown in FIG. 2 in which the detent lever hook 30 becomes disengaged from the fork-bolt hook 32. With this disengagement, the latch bolt 16 is permitted to begin pivoting about its pivot 18 by its spring to the phantom line indicated unlatched position of FIG. 2 in which the latch bolt 16 is disengaged from the striker 22. Thus, the spring associated with the hinge of the closure panel 10 is permitted to move the closure panel 10 to the fully opened position As the deck lid 10 continues its upward movement from the position shown in FIG. 2, the plunger 54 continues to be extended from the housing 50 so that the dwell portion 64 of the plunger cam retains the cam disc 74 and actuating lever 76 at their rotary position of FIG. 6 retaining the detent lever 26 in the disengaged position. The dwell portion 64 is sufficient in length to assure that the upward opening movement of the closure panel 10 proceeds to such a degree that the latch bolt 16 has completely cleared the striker 22 to prevent an inadvertent relatching of the latch bolt to the striker.

Figure 7:
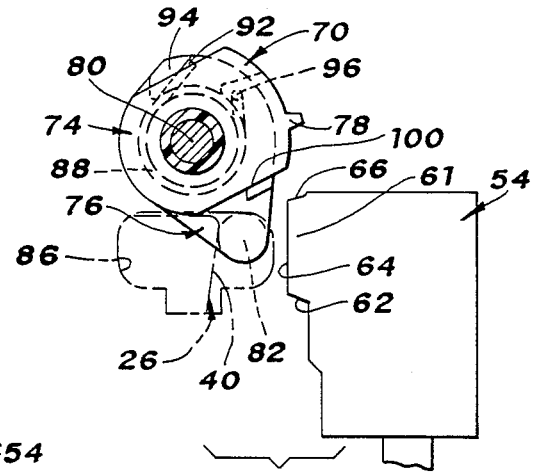

In FIG. 7 the full opening movement of the closure 10 has permitted the plunger 54 to be fully extended from housing 50 so that the cam disc 74 and actuating lever 76 have been returned in the counterclockwise direction by the return of the detent lever 26 to its detenting position shown in phantom in FIG. 7.

Figure 8:
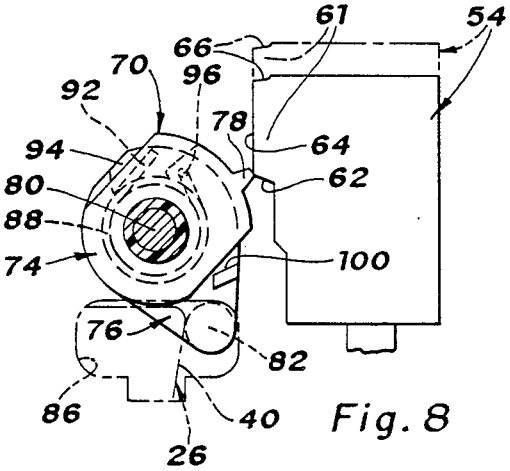

During a subsequent closure of the closure panel 10, the plunger 56 will again engage with the abutment 58 and initiate retraction of the plunger 54 into the housing 50. FIG. 8 shows the retraction of the plunger 54 in progress so that the riser 66 has engaged with the projection 78 and the dwell portion 64 to cause the cam disc 74 to have rotated away from the stop abutment 100 of actuating lever 90. The engagement of the lateral arm 82 of the actuating lever with the wall of the window 86 of the housing 14 effectively prevents the actuating lever 76 from rotating in the counterclockwise direction in unison with the cam disc 74.

Any further retraction of the plunger 54 to the phantom indicated position of FIG. 4 permits the torsion spring 88 to return the cam disc 74 into its normal position engaging with the stop abutment 100 of the actuator lever 76.

Thus it is seen that the invention provides a new and novel closure pull down mechanism in which a plunger associated with the latch assembly projects into engagement with the vehicle body and is extended from the latch assembly upon opening movement of the closure panel to trigger a cam mechanism which unlatches the latch assembly.

It will be appreciated that the cam disc 74 and the actuating lever 76 disclosed herein may be replaced by a one piece lever or disc if the window 86 is sufficiently enlarged to provide a sufficient degree of rotary movement It will also be appreciated that the release mechanism of this invention may be utilized in vehicles in which the latch assembly is mounted on the body panel 11 by a motorized pull down unit and the striker 22 is mounted on the closure panel. In this case, the plunger 54 would project upwardly from the body panel 11 toward the closure panel and the stop surface 58 engageable by the plunger 54 would be mounted on the closure panel.

The embodiments of the invention in which an exclusive property or privilege is claimed are defined as follows:

1. In a vehicle body including a closure panel mounted for movement between open and closed positions with respect to a compartment defined by a body panel, a latch and pull down mechanism comprising:

a latch assembly mounted on one of the panels and having a latch bolt spring biased to an unlatched position and a detent lever for holding the latch bolt in the latched position;

a striker assembly mounted on the other panel and adapted for engagement by the latch bolt of the latch assembly to latch the striker assembly to the latch assembly;

a pulldown mechanism mounting one of the assemblies on its associated panel and having a motorized drive unit for moving the one assembly between an extended position where the striker and the latch bolt are engageable together upon partial closing movement of the closure panel, and a retracted position in which the latch assembly and the striker assembly cooperate to establish the closure panel in the closed position;

means adapted to operate the motorized drive unit to move the one assembly to the retracted position to pull the closure panel to the closed position in response to latching engagement between the striker assembly and the latch bolt;

remote opening means actuatable by the user for selectively operating the motorized drive unit to move the one assembly toward the extended position so that the closure panel is moved in the opening direction;

and cam means acting in response to motorized movement of the one assembly from its retracted position toward its extended position to cam the detent lever to a position releasing the detent lever from the latch bolt, said cam means including a plunger movably mounted on the latch assembly and projecting into engagement with the other panel when the closure panel is in the closed position and spring means urging extension of the plunger so that the plunger is extended relative the latch assembly upon opening movement of the closure, whereby the latch bolt is spring biased to the unlatched position thereby disconnecting the latch assembly from the striker and freeing the closure panel for spring-loaded movement to the open position.

2. The combination of claim 1 in which the cam means including the plunger is effective to maintain the released position of the detent lever and the unlatched position of the latch bolt until the opening movement of the panel carries the latch bolt a distance from the striker so that the latch bolt does not become reengaged with the striker prior to a subsequent closing movement of the closure panel.

3. In a vehicle body including a closure panel mounted for movement between open and closed positions with respect to a compartment defined by a body panel, a latch and pull down mechanism comprising:

a latch assembly mounted on one of the panels and having a latch bolt spring biased to an unlatched position and a detent lever for holding the latch bolt in the latched position;

a pull down mechanism mounted on the other panel and including a striker mounted thereon by a motorized drive unit for movement between an extended position where the striker is engageable by the latch bolt of the latch assembly to latch the panels together upon partial closing movement of the closure panel, and a retracted position in which the closure panel is in the closed position;

means adapted to operate the motorized drive unit to move the striker to the retracted position to pull the closure panel to the closed position upon latching engagement between the striker and the latch assembly, remote opening means actuatable by the user for selectively operating the motorized drive unit to move the striker from the retracted position toward the extended position, and cam means acting in response to motorized movement of the striker from its retracted position toward its extended position to cam the detent lever to a position releasing the detent lever from the latch bolt, said cam means including a plunger movably mounted on the latch assembly and projecting into engagement with the other panel when the closure panel is in the closed position and spring means urging extension of the plunger so that the plunger is extended relative the latch assembly upon opening movement of the closure panel, whereby the latch bolt is spring biased to the unlatched position thereby disconnecting the latch assembly from the striker and freeing the closure panel for spring-loaded movement to the open position.

4. In a vehicle body including a closure panel spring-loaded for movement between open and closed positions with respect to a compartment defined by a body panel, a latch assembly mounted on one of the panels and having a latch bolt for engaging a striker assembly mounted on the other panel and a motorized drive unit mounting one of the assemblies for movement between an extended position where the striker is engageable by the latch bolt to latch the panels together upon partial closing movement of the closure panel and a retracted position in which the closure panel is in the closed position, and remote opening means actuatable by the user for selectively operating the motorized drive unit to move the one assembly from the retracted position toward the extended position, the improvement comprising:

a plunger movably mounted on the latch assembly and projecting into engagement with the other panel when the closure panel is in the closed position, spring means urging extension of the plunger so that the plunger is extended relative the latch assembly upon opening movement of the closure panel, and release means acting between the plunger and the latch bolt and effective to release the latch bolt from the striker in response to extension of the plunger by the spring means upon opening movement of the closure panel thereby disconnecting the latch assembly from the striker and freeing the closure panel for spring-loaded movement to the open position.

5. In a vehicle body including a closure panel spring-loaded for movement between open and closed positions with respect to a compartment defined by a body panel, and a latch assembly mounted on one of the panels and having a latch bolt for engaging a motorized striker mounted on the other panel for movement between an extended position where the striker is engageable by the latch bolt to latch the panels together upon partial closing movement of the closure panel and a retracted position in which the closure panel is in the closed position, and remote opening means actuatable by the user for selectively operating the motorized drive unit to move the striker from the retracted position toward the extended position, the improvement comprising:

a plunger movably mounted on the latch assembly and projecting into engagement with the other panel when the closure panel is in the closed position, spring means urging extension of the plunger so that the plunger is extended relative the latch assembly upon opening movement of the closure panel, lever means pivotally mounted on the latch assembly and pivotal to release the latch bolt from the striker, and cam means acting between the plunger and the lever means to pivot the lever means in response to extension of the plunger by the spring means upon opening movement of the closure panel thereby disconnecting the latch assembly from the striker and freeing the closure panel for spring-loaded movement to the open position.

* * * * *